US010902700B2

(12) United States Patent
Montenegro

(10) Patent No.: US 10,902,700 B2
(45) Date of Patent: Jan. 26, 2021

(54) SYSTEMS AND METHODS OF ELECTRONIC GAMING

(71) Applicant: Aristocrat Technologies Australia Pty Limited, North Ryde (AU)

(72) Inventor: Daniel Julio Montenegro, Endeavor Hills (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/657,856

(22) Filed: Oct. 18, 2019

(65) Prior Publication Data

US 2020/0051383 A1 Feb. 13, 2020

Related U.S. Application Data

(63) Continuation of application No. 15/285,343, filed on Oct. 4, 2016, now Pat. No. 10,453,302, which is a (Continued)

(30) Foreign Application Priority Data

Apr. 27, 2010 (AU) ..... 2010901764

(51) Int. Cl.
*G07F 17/32* (2006.01)
*G07F 17/34* (2006.01)

(52) U.S. Cl.
CPC ..... *G07F 17/3244* (2013.01); *G07F 17/3209* (2013.01); *G07F 17/3213* (2013.01); (Continued)

(58) Field of Classification Search
None
See application file for complete search history.

(56) References Cited

U.S. PATENT DOCUMENTS 6,893,342 B1 5/2005 Singer et al.
9,460,586 B2 10/2016 Montenegro
(Continued)

FOREIGN PATENT DOCUMENTS

AU 2004224937 A1 5/2005
AU 2004298286 A1 7/2006
(Continued)

OTHER PUBLICATIONS

United States Patent and Trademark Office, "Office Action", issued in connection with U.S. Appl. No. 13/094,579, dated Jun. 25, 2012 (19 pages).

*Primary Examiner* — Jason T Yen
(74) *Attorney, Agent, or Firm* — Armstrong Teasdale LLP

(57) ABSTRACT

A gaming system displays a plurality of columns, receives a selection of at least one column, and determines a set of win lines to be played during the game, wherein the set of win lines is defined, at least, by combining each symbol display position of the selected column with one symbol display position of each non-selected column. When a single column is selected, a number of win lines is equal to a total number of symbol display positions of the single selected column. When more than one column is selected, the number of win lines is equal to a number of symbol display positions of a first selected column multiplied by a respective number of symbol display positions of each other selected column. The gaming system also determines a symbol to be displayed at each position, populates each position with a symbol, and determines an outcome of the game.

20 Claims, 7 Drawing Sheets

Related U.S. Application Data continuation of application No. 13/724,694, filed on Dec. 21, 2012, now Pat. No. 9,460,586, which is a continuation of application No. 13/094,579, filed on Apr. 26, 2011, now abandoned.

(52) U.S. Cl.
CPC ..... *G07F 17/3225* (2013.01); *G07F 17/3246* (2013.01); *G07F 17/3251* (2013.01); *G07F 17/3258* (2013.01); *G07F 17/3267* (2013.01); *G07F 17/34* (2013.01)

(56) References Cited

U.S. PATENT DOCUMENTS

| | | | | |
|---|---|---|---|---|
| 2004/0204228 | A1 | 10/2004 | Walker | |
| 2005/0009597 | A1 | 1/2005 | Daly | |
| 2007/0187693 | A1 | 8/2007 | Kobayakawa et al. | |
| 2008/0064477 | A1 | 3/2008 | Fong et al. | |
| 2008/0064480 | A1 | 3/2008 | Randall | |
| 2008/0076521 | A1 | 3/2008 | Little | |
| 2008/0090636 | A1* | 4/2008 | Lathrop | G07F 17/32 463/20 |
| 2008/0108408 | A1* | 5/2008 | Wolf | G07F 17/34 463/20 |
| 2008/0128542 | A1 | 6/2008 | Majima et al. | |
| 2008/0182653 | A1 | 7/2008 | O'Halloran et al. | |
| 2008/0287178 | A1 | 11/2008 | Berman | |
| 2009/0117980 | A1 | 5/2009 | Yoshizawa | |
| 2009/0117988 | A1 | 5/2009 | Mathis | |
| 2009/0131161 | A1 | 5/2009 | Lim et al. | |
| 2009/0191948 | A1 | 7/2009 | Kim | |
| 2009/0270165 | A1* | 10/2009 | Dias Pires | G07F 17/34 463/20 |
| 2009/0298572 | A1* | 12/2009 | Stewart | G07F 17/34 463/20 |
| 2009/0305768 | A1* | 12/2009 | McKay | G07F 17/3262 463/20 |
| 2011/0065492 | A1 | 3/2011 | Acres | |
| 2011/0223984 | A1 | 9/2011 | Mizue | |
| 2012/0088566 | A1 | 4/2012 | Montenegro | |

FOREIGN PATENT DOCUMENTS

| | | | |
|---|---|---|---|
| AU | 2005232302 | A1 | 8/2006 |
| AU | 2006201690 | A1 | 11/2006 |
| AU | 2006202976 | A1 | 2/2007 |
| AU | 2008249533 | A1 | 12/2008 |
| CN | 101024614 | A | 8/2007 |
| CN | 101251959 | A | 8/2008 |
| CN | 101298042 | A | 11/2008 |
| CN | 201161106 | Y | 12/2008 |
| CN | 101495766 | A | 7/2009 |
| JP | 2003006281 | A | 1/2003 |
| JP | 2006334312 | A | 12/2006 |
| JP | 2007125062 | A | 5/2007 |
| JP | 2007190079 | A | 8/2007 |
| JP | 2007209429 | A | 8/2007 |
| JP | 2007260115 | A | 10/2007 |
| JP | 2007312886 | A | 12/2007 |
| JP | 2008029726 | A | 2/2008 |
| JP | 2008029727 | A | 2/2008 |
| JP | 2008043694 | A | 2/2008 |
| JP | 2008077489 | A | 4/2008 |
| JP | 2008086530 | A | 4/2008 |
| JP | 2008194197 | A | 8/2008 |
| JP | 2008220740 | A | 9/2008 |
| JP | 2008279053 | A | 11/2008 |
| JP | 2009131308 | A | 6/2009 |
| RU | 2360085 | C1 | 6/2009 |
| WO | 2005058444 | A1 | 6/2005 |
| WO | 2008151012 | A1 | 12/2008 |
| WO | 2008157837 | A1 | 12/2008 |
| WO | 2009001290 | A2 | 12/2008 |

* cited by examiner

SYSTEMS AND METHODS OF ELECTRONIC GAMING

CROSS-REFERENCE TO RELATED APPLICATIONS

The present application claims the benefit of priority to U.S. patent application Ser. No. 15/285,343, filed on Oct. 4, 2016, entitled "SYSTEMS AND METHODS OF ELECTRONIC GAMING," now allowed, which claims the benefit of priority to U.S. patent application Ser. No. 13/724,694, filed on Dec. 21, 2012, entitled "METHOD OF GAMING, A GAMING SYSTEM AND A GAME CONTROLLER," now U.S. Pat. No. 9,460,586, which claims the benefit of priority to U.S. patent application Ser. No. 13/094,579, filed on Apr. 26, 2011, entitled "METHOD OF GAMING, A GAMING SYSTEM AND A GAME CONTROLLER," now abandoned, which claims the benefit of priority to Australian Provisional Patent Application No. 2010901764, filed on Apr. 27, 2010, entitled "A GAMING SYSTEM AND A METHOD OF GAMING," each of which is herein incorporated by reference in its entirety.

BACKGROUND

The subject matter of the present disclosure relates to a method of electronic gaming, an electronic gaming system, and an article of manufacture for electronic gaming. Conventional gaming systems may employ symbol-driven jackpots, in which a jackpot prize is awarded based upon a winning combination of symbols. A need exists for alternative gaming systems in order to maintain or increase player enjoyment.

SUMMARY

Systems, methods, and articles of manufacture for electronic gaming are disclosed. In a first aspect, a gaming system may implement a method of electronic gaming. The method may include displaying columns of symbol display positions, at least some of the columns having differing numbers of symbol display positions, defining winning combinations of symbol display positions having at least one symbol display position from each of said columns, facilitating selection of at least one of said columns by a player for selection of winning combinations to be played in a game, the selected winning combinations to be played including all possible winning combinations derivable from all symbol display positions of said selected at least one column and a designated symbol display position from each of said columns which the player did not select, selecting symbols for display in said symbol display positions, and determining a game outcome based on the symbols displayed in said selected winning combinations.

In a second aspect, a gaming system may implement a display including columns of symbol display positions, at least some of the columns having differing numbers of symbol display positions, a winning combination module arranged to define winning combinations of symbol display positions having at least one symbol display position from each of said columns, a winning combination selector arranged to facilitate selection of at least one of said columns by a player for selection of winning combinations to be played in a game, the selected winning combinations to be played including all possible winning combinations derivable from all symbol display positions of said selected at least one column and a designated symbol display position from each of said columns which the player did not select, a symbol selector arranged to select symbols for display in said symbol display positions, and an outcome determiner arranged to determine a game outcome based on symbols displayed in said selected winning combinations.

The electronic gaming system may further comprise a game controller including a winning combination module arranged to define winning combinations of symbol display positions having at least one symbol display position from each one of a plurality of columns of symbol display positions, at least some of the plurality of columns having differing numbers of symbol display positions, a winning combination selector arranged to facilitate selection of at least one of said columns by a player for selection of winning combinations to be played in a game, the selected winning combinations to be played including all possible winning combinations derivable from all symbol display positions of said selected at least one column and a designated symbol display position from each of said columns which the player did not select, a symbol selector arranged to select symbols for display in said symbol display positions and an outcome determiner arranged to determine a game outcome based on symbols displayed in said selected winning combinations.

In another aspect, the invention provides a gaming system including at least one gaming device including a cabinet, a display including columns of symbol display positions, the display mounted within the cabinet, a game play mechanism mounted to the cabinet incorporating at least one input device, the game play mechanism operable by a player to place wagers in a game, and a game controller disposed within the cabinet including a processor and a memory storing game control instructions which enable the game controller to operate, the game controller including a winning combination module arranged to define winning combinations of symbol display positions having at least one symbol display position from each of said columns, at least some of the columns having differing numbers of symbol display positions, a winning combination selector arranged to facilitate selection of at least one of said columns by the player for selection of winning combinations to be played in the game, the selected winning combinations to be played including all possible winning combinations derivable from all symbol display positions of said selected at least one column and a designated symbol display position from each of said columns which the player did not select, a symbol selector arranged to select symbols for display in said symbol display positions, and an outcome determiner arranged to determine a game outcome based on symbols displayed in said selected winning combinations.

In yet another aspect, an article of manufacture a non-transitory, tangible, computer readable storage medium having instructions stored thereon that, in response to execution by a computer-based system configured for electronic gaming, cause the computer-based system to perform operations comprising displaying columns of symbol display positions, at least some of the columns having differing numbers of symbol display positions, defining winning combinations of symbol display positions having at least one symbol display position from each of said columns, facilitating selection of at least one of said columns by a player for selection of winning combinations to be played in a game, the selected winning combinations to be played comprising all possible winning combinations derivable from all symbol display positions of said selected at least one column and a designated symbol display position from each of said columns which the player did not select, selecting symbols for display in said symbol display positions, and determining a game outcome based on symbols displayed in said selected winning combinations.

BRIEF DESCRIPTION OF THE DRAWINGS

Certain exemplary embodiments will now be described with reference to the accompanying drawings in which.

Figure 1:
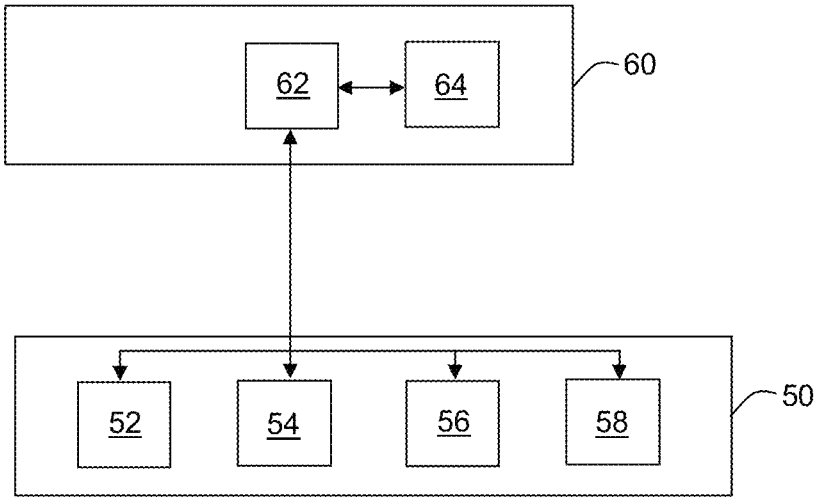
FIG. 1 is a block diagram of the core components of a gaming system.

The foregoing summary, as well as the following detailed description of certain embodiments of the present invention, will be better understood when read in conjunction with the drawings. For the purpose of illustrating the invention, certain embodiments are shown in the drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended claims are read to cover a purely software and/or firmware implementation, at least one of the elements in an at least one example is hereby expressly defined to include a tangible medium such as a memory, DVD, CD, Blu-ray, etc. storing the software and/or firmware.

Referring to the drawings, a method and a gaming system for implementing the method are shown. In the embodiment, the method includes displaying columns of symbol display positions, whereby at least some of the columns have differing numbers of symbol display positions. The method also includes defining winning combinations of symbol display positions having at least one symbol display position from each of said columns, and facilitating selection of at least one of the columns by a player for selection of winning combinations to be played in a game. The selected winning combinations to be played include all possible winning combinations derivable from all symbol display positions of the selected column or columns and a designated symbol display position from each of the columns which the player did not select. The method further includes selecting symbols for display in the symbol display positions and determining a game outcome based on symbols displayed in the selected winning combinations.

General Construction of an Exemplary Gaming System

The present disclosure may be implemented in various configurations for gaming machines, including but not limited to: (1) a gaming machine in which the computerized instructions for controlling one or more games are stored within the gaming machine prior to delivery to a gaming establishment; and/or (2) a changeable gaming machine in which the computerized instructions for controlling one or more games are subsequently downloaded to the gaming machine through a data network after the gaming machine is installed within in a gaming establishment.

In an exemplary embodiment, the computerized instructions for controlling one or more games may be executed by a server, such as, for example, a central controller or remote host. In such a "thin client" architecture, the server may remotely control one or more games, or other suitable interfaces, via a gaming network, and the gaming machine may be used to display the games, or suitable interfaces, and to receive inputs or commands from a player.

In another exemplary embodiment, the instructions for controlling one or more games are communicated from a server to a local processor and memory coupled within a gaming machine. In such a "thick client" architecture, a processor of the gaming machine may execute the communicated instructions to control the game or games and/or other suitable interfaces provided to a player.

In another exemplary embodiment, one or more gaming machines within a gaming machine network may utilize a thin client architecture and one or more gaming machines within a gaming machine network may utilize a thick client architecture. Similarly, in various exemplary embodiments, certain functions of a particular gaming machine may be implemented in a thin client architecture and certain other functions of the gaming machine may be implemented in a thick client architecture. For instance, instructions for controlling a game or games may be communicated from a server to one or more network gaming machines operating in a thick client configuration, while instructions for controlling any secondary games or bonus gaming functions may executed by the server in a thin client configuration.

FIG. 1 is a block diagram of an exemplary player interface 50 and game controller 60 of gaming machine 10. Player interface 50 and game controller 60 may be housed within gaming machine 10 (shown in FIG. 2), such as on a printed circuit board located within cabinet 12 (shown in FIG. 2) of gaming machine 10. As described herein, player interface 50 may be arranged to enable manual interaction between a player and the gaming system and for this purpose includes various input/output components required for the player to enter instructions to play the game and observe the game outcomes.

Components of player interface 50 may include at least one credit input mechanism 52, at least one display 54, a game play mechanism 56 (including one or more input devices that enable a player to input game play instructions or place a wager), and/or one or more audio output devices 58 (e.g., one or more speakers).

Game controller 60 may be in data communication with player interface 50 and may include at least one processor 62 or other suitable controller, such as a microprocessor, a microcontroller-based platform, a suitable integrated circuit or one or more application-specific integrated circuits (ASICs). Processor 62 may be coupled in communication with, or may be operable to access or to exchange signals with, at least one data storage module or memory 64. Processor 62 may thus be configured to retrieve game play instructions from memory 64, process the game play instructions in accordance with game play rules, and output one or more game play outcomes to display 54.

Memory 64 may include any suitable tangible, non-transitory, computer-readable storage medium. Memory 64 may store program code and instructions, executable by processor 62, to control gaming machine 10. Memory 64 may also store other data, such as, for example, image data, one or more pay tables or pay table data, event data, player input data, random or pseudo-random number generators, or numbers generated by a random number of pseudo-random number generator, look-up table data, and/or information and applicable game rules that relate to the play of gaming machine 10. It should also be appreciated that processor 62 and memory 64 may be collectively referred to herein as a "computer" or "controller."

Figure 4:
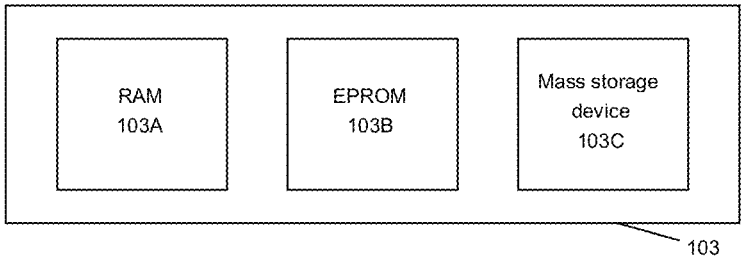
FIG. 4 is a schematic diagram of the functional components of a memory.

With brief attention to FIG. 4, a block diagram of a memory 103 is shown. In various embodiments, memory 103 is the same as memory 64. Memory 103 may include random access memory (RAM) 103A, such as non-volatile RAM (NVRAM), magnetic RAM (MRAM), ferroelectric RAM (FeRAM) and other forms as commonly understood in the gaming industry. Memory 103 may further include read only memory (ROM), such as EPROM 103B or electrically erasable programmable read only memory (EEPROM). Memory 64 may further include one or more mass storage devices 103C, such as one or more hard drives, one or more solid state or flash memory components, one or more CD and/or DVD drives, and the like. Any other suitable magnetic, optical, and/or semiconductor memory may be used to operate in conjunction with gaming machine 10 that enables gaming machine 10 to function as described herein.

In an exemplary embodiment, RAM 103A may temporarily store one or more program files (and/or other related data) for execution by processor 62. EPROM 103B may include a boot ROM device and/or may contain some system or game related code. Mass storage device 103C may store one or more game programs, the integrity of which may be verified and/or authenticated by the processor 62 through the use of protected or encrypted code stored, for example, on EPROM 103B.

In various embodiments, part or all of the program code and/or operating data described above is stored in a detachable or removable memory, including, but not limited to, a suitable cartridge, disk, CD ROM, DVD or USB memory device. In addition, in various embodiments, all or part of the program code and/or operating data described above may be downloadable to memory 64 by way of any suitable computer network.

In an exemplary embodiment, a desktop computer, a laptop personal computer, a personal digital assistant (PDA), a smartphone, a tablet computing device or other portable computing device, and/or any other computerized platform may implement the computing operations of the present disclosure. For example, any suitable mobile computing device, such as any smartphone or tablet computing device, may implement and enable gameplay as described herein. It should be appreciated that each gaming machine 10 disclosed herein may include a device that has obtained approval from a regulatory gaming commission or a device that has not obtained approval from a regulatory gaming commission.

Returning to FIG. 1, in an exemplary embodiment, a credit input mechanism 52 may be coupled in communication with processor 62. Credit input mechanism 52 may include any suitable credit input mechanism or device, such as a coin input chute 24A (shown in FIG. 2), a bill or ticket collector 24B (shown in FIG. 2), and the like. Credit input mechanism 52 may be configured to receive any suitable monetary credit, such as money, coins, tokens, tickets, and the like. In various embodiments, credit input mechanism 52 may further include card reader devices, such as credit or debit card readers or validators for credit cards, debit cards, printed ticket printers and/or readers, and the like.

Figure 2:
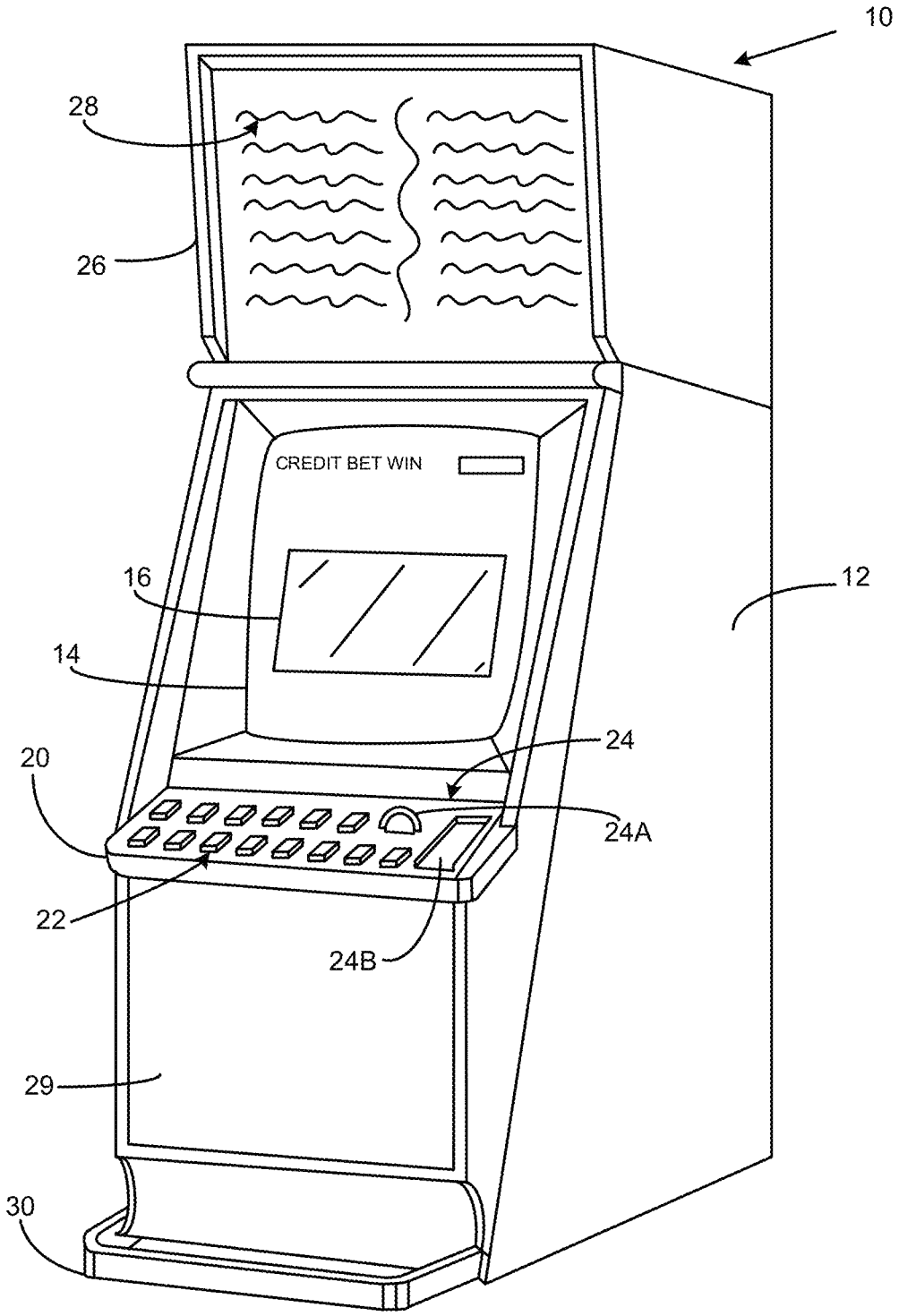
FIG. 2 is a perspective view of a stand alone gaming machine.

In various embodiments, a player may insert an identification card (not shown) into a card reader of gaming machine 10 (shown in FIG. 2). The identification card may be a smart card that includes a programmed microchip or a magnetic strip coded with a player's identification, credit totals (or related data) and other relevant information. A player may further carry a portable device, such as a cell phone or smart phone, a radio frequency identification tag or any other suitable wireless communication device, which communicates a player's identification, credit totals (or related data) and other relevant information to gaming machine 10. In an embodiment, money may be transferred to gaming machine 10 via an electronic funds transfer process. When a player funds gaming machine 10, processor 62 may determine an amount of funds entered and display the corresponding amount on the display 54.

Game play mechanism 56 may include at least one input device that is coupled in communication with processor 62. An input device may include any device that enables a player to produce an input signal that is receivable by processor 62. For example, in one embodiment, after funding gaming machine 10, the input device may include a game activation device, such as a pull arm or one or more play buttons 22 (shown in FIG. 2) that enables the player to start the game or a sequence of events in gaming machine 10. Play button 22 may include any suitable play activator such as, for example, a bet one button, a max bet button, or a repeat the bet button. In one embodiment, after appropriate funding of gaming machine 10, game play may begin automatically.

In an exemplary embodiment, one input device may include a "Bet One" button. A player may place a wager or bet by pushing the Bet One button and may increase the wager by repeatedly depressing or selecting the Bet One button. In various embodiments, an input device includes a "Bet Max" button that enables a player to place a maximum wager permitted during a particular game or game session.

In various embodiments, an input device may also include a "Cash Out" button. A player may depress or select a Cash Out button to receive a cash payment or other suitable form of payment corresponding to the number of credits remaining. In an embodiment, when the player cashes out, the player receives coins or tokens in a coin payout tray. A player may further receive tickets or credit slips, or the player's electronically recordable identification card may be funded, in response to selection of a Cash Out button.

In various embodiments, an input device may include a touch-screen that is coupled to a touch-screen controller, or some other touch-sensitive display overlay, to enable player interaction with images presented on display 54. A touch-screen and/or touch-screen controller may be communicatively coupled to a video controller, such that a player may provide input signals to gaming machine 10 by physically manipulating or interacting with the touch-screen.

Gaming machine 10 may include a sensor, such as a camera (not shown) coupled in communication with processor 62. The camera may, in various embodiments, be controlled by processor 62, such that a player may direct the orientation and focus of the camera to acquire an image of a player actively playing gaming machine 10 and/or a surrounding area of gaming machine 10. In an exemplary embodiment, the camera may selectively acquire still or moving (e.g., video) images and may be configured to acquire the images in either an analog, digital, or other suitable format. Display 54 may be configured to display the image acquired by the camera, as well as to display the visible manifestation of the game in split screen or picture-in-picture fashion. For example, the camera may acquire an image of the player and processor 62 may incorporate that image into the interactive and/or secondary game as a game image, symbol or indicia FIG. 2 is a perspective view of an exemplary gaming machine 10. Gaming machine 10 may include a support structure, housing, console or cabinet 12 that provides support for a plurality of interface units, displays, inputs, controls and other features of a conventional gaming machine. Gaming machine 10 may be configured so that a player can operate it while standing or sitting. Moreover, gaming machine 10 may be positioned on a base or stand, or can be configured as a pub-style table-top game (not shown) that a player can operate while seated. Gaming machine 10 may include varying numbers and styles of cabinets 12, display configurations, and the like without departing from the scope of the present disclosure.

In an exemplary embodiment, gaming machine 10 includes a console 12 having a display 14 that displays a game 16 that can be played by a player. In an exemplary embodiment, display 14 is the same as display 54 shown in FIG. 1. Gaming machine 10 may also include a mid-trim 20, which may house a bank of buttons 22 for enabling a player to interact with gaming machine 10 and/or a credit input mechanism 52.

Gaming machine 10 may also include a player marketing module configured to scan or read a player tracking device, such as, for example a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

Gaming machine 10 may further include a top box 26, which may, in turn, include artwork 28, such as, for example, artwork depicting one or more pay tables, bonus award information, an upper display (not shown), and/or other game information or imagery. Further artwork and/or information may be provided on a front panel 29 of console 12. A coin tray 30 may be mounted beneath front panel 29 for dispensing cash payouts from gaming machine 10.

Display 14 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In an exemplary embodiment, display 14 includes a touch-screen or touch-sensitive screen. In various embodiments, display 14 may be of any suitable size and configuration, such as any circular, square, rectangular, or other geometric configuration.

Display 14 may be further configured to provide haptic feedback. Top box 26 may also include a display, which may be of the same or different from display 14.

Display 14 may, in various embodiments, display a game and/or accept game play data from a player. Moreover, display 14 may also display information relating to an interactive game, wager triggering event, or wagering outcome. In an exemplary embodiment, an upper display (not shown) mounted in top box 26 may display any wagering outcome, any suitable secondary game associated or not associated with the interactive game, or any information relating to the interactive games. The upper display may also be configured to accept game play data from a player.

Display 14 may, in addition, serve as digital signage operable to advertise one or more games or other aspects of the gaming establishment. In an exemplary embodiment, gaming machine 10 may also include a credit or fund display 20, which may display a player's current number of credits, cash accumulated, account balance, an original number of credits the player funded the gaming machine with, or an equivalent of any of the aforementioned, and the like. Moreover, in an exemplary embodiment, display 14 may display an amount being wagered or a player's accumulated winnings.

In an exemplary embodiment, and as described in greater detail herein, display 14 may display at least one game or game image, game symbol or symbols, and game indicia, such as any visual representation or exhibition of a movement of objects, including, for example, any mechanical, virtual, or video reels and wheels, dynamic lighting, video images, images of people, characters, places, things and faces of cards, and the like. In various embodiments, the symbols, images and indicia described above may be displayed mechanically, such as by one or more mechanical or physical reels. In other words, display 14 may include any electromechanical device, such as one or more rotatable or spinning wheels, reels or dice, any of which may be configured to display at least one or a plurality of games or other suitable images, symbols or indicia.

Figure 3:
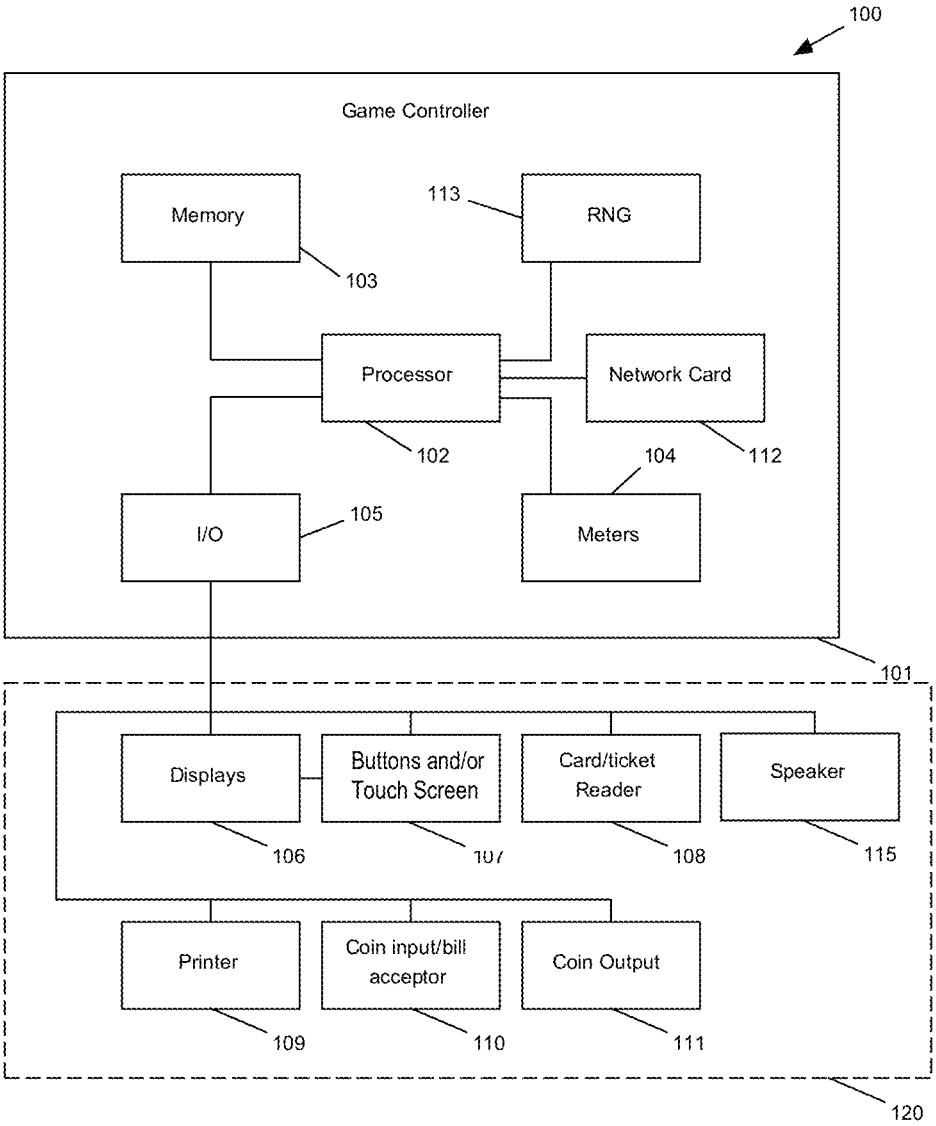
FIG. 3 is a block diagram of the functional components of a gaming machine.

FIG. 3 illustrates a more detailed block diagram of various exemplary functional components of a gaming machine 100, which may be the same as, or different from, gaming machine 10 (as shown in FIG. 2). The foregoing description of components (e.g., display 14, player interface 50, and game controller 60) may therefore apply to the description of similar components in gaming machine 100. For instance, processor 62 may be the same as or different from 102, as described below. Similarly, memory 64 may be the same as or different from the memory 103, as described below.

Accordingly, gaming machine 100 may include a game controller 101 (which may include a processor 102 mounted on a circuit board, a described in greater detail above). Instructions and data to control operation of processor 102 may be stored in a memory 103 that is in data communication with processor 102. Gaming machine 100 may include both volatile and non-volatile memory and more than one of each type of memory, with such memories being collectively represented by memory 103.

Gaming machine 100 may also include hardware meters 104 (to ensure regulatory compliance and to monitor player credit) and/or an input/output (I/O) interface 105 (for communicating with peripheral devices of gaming machine 100). Input/output interface 105 and/or the peripheral devices may include intelligent devices with their own memory for storing associated instructions and data. A random number generator module 113 may generate random numbers for use by processor 102. Persons skilled in the art will appreciate that random number generator module 113 includes a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, a coin output mechanism 111, and a speaker 115. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game).

Additional hardware may be included as part of gaming machine 100 or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information and/or other information to a bonus controller, central controller, server or database and receive data or commands from the bonus controller, central controller, an/or server or database. In various embodiments (e.g., embodiments that employ a player marketing module), communications over a network may be via the player marketing module—e.g., the player marketing module may be in data communication with one or more of the above devices.

In various embodiments, components of gaming machine 100 may be distributed. For example, in an embodiment, input/output devices 106, 107, 108, 109, 110, 111, and 115 may be provided remotely from game controller 101.

Figure 5:
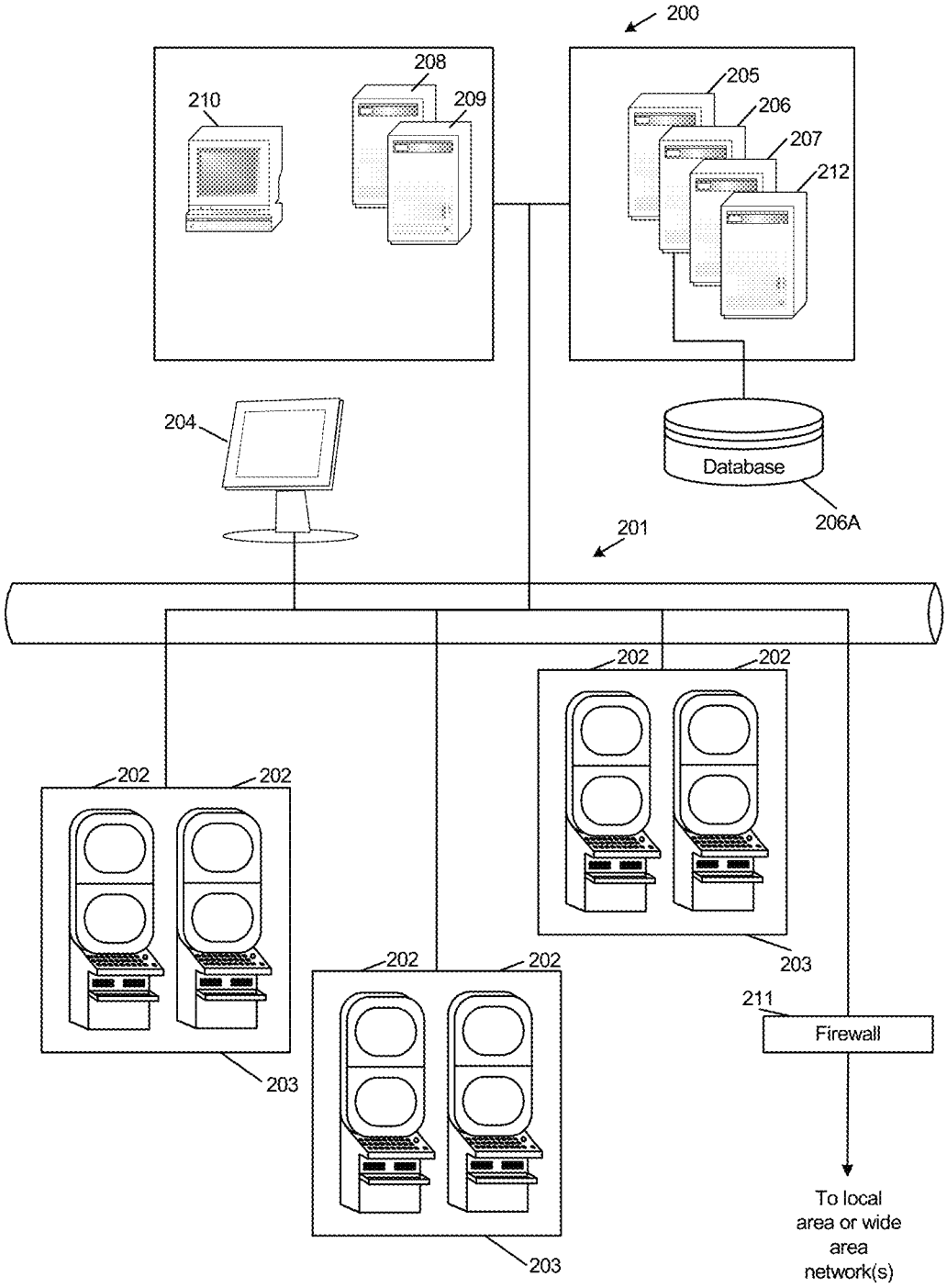
FIG. 5 is a schematic diagram of an exemplary network gaming system.

FIG. 5 illustrates such an exemplary distributed gaming system 200. Gaming system 200 may include a network 201, which, for example, may include a wired or wireless network, such as a Wi-Fi or BLUETOOTH network, an Ethernet network, an RS-232 network, and/or any combination thereof. In an exemplary embodiment, gaming machines 202, shown arranged in three banks 203 of two gaming machines 202, are connected to network 201. Gaming machines 202 may provide a player operable interface and may be the same as (or substantially similar to) the gaming machines 10 and 100 (as shown in FIGS. 2 and 3), or may have simplified functionality depending, for example, on various game play requirements.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example promotional or informational material. Displays 204 may be the same as or substantially similar to display 14 and/or display 54, as described above.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively include a game controller. A database management server 206 may manage storage of game programs and associated data for downloading or access by gaming machines 202 in a database 206A. Typically, if gaming system 200 enables players to participate in a jackpot game, a jackpot server 207 may be provided to perform accounting functions for the jackpot game. A loyalty program server 212 may also be provided.

In a thin client embodiment, game server 205 may implement most or all of the game played by a player using gaming machine 202, and gaming machine 202 may, in essence, function provide little more than the player interface. In such an embodiment, game server 205 may include the game controller. Gaming machine 202 may thus receive player instructions and transmit those instructions to game server 205. Further, in a thin client embodiment, gaming machines 202 may be computer terminals, such as, for example, personal computers, laptop computers, tablet computing devices, smartphones, and the like running software that provides a player interface. Other client/server configurations are contemplated and are within the scope of this disclosure. Additional details of a client/server architecture may be found in WO 2006/052213 and PCT/SE2006/000559, the disclosures of which are incorporated herein by reference in their entireties.

One or more servers may be provided to assist in the administration of gaming system 200. Such servers may include, for example, a gaming floor management server 208, and a licensing server 209 to monitor the use of licenses relating to particular games. An administrator terminal 210 may be provided to allow an administrator to run network 201 and the devices connected to network 201.

Gaming system 200 may communicate with other gaming systems and/or other local networks, such as, for example a corporate network, and/or a wide area network such as the Internet Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 may implement a random number generator engine. Alternatively, a separate random number generator server may be provided. Further, persons skilled in the art will appreciate that a plurality of game servers may be provided to implement different games or a single game server may implement a plurality of different games as required by the terminals.

Further Details of an Exemplary Gaming System

In an exemplary embodiment, a player may place a wager using game play mechanism 56. A game (or game session) may be initiated in response to placement of the wager. A plurality of symbols randomly are drawn, and a game (or game session) outcome is determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In various embodiments, a wager may include a selection of a number of lines to be played during a game session. Such lines may include an interconnected combination of symbol display positions. Each selected line may be evaluated to identify winning combinations of symbols. A pay table (e.g., a pay table stored in memory 64) may be referenced to identify a payout or award based upon an identified winning combination of symbols. In various embodiments, an award may be multiplied or increased by a multiplication factor as well.

In an exemplary embodiment, gaming machine 202 may generate an award that is not based solely upon a number of a lines selected. For example, "scatter" pays (e.g., randomly selected awards that are not identified based upon a plurality of adjacent symbols) may be awarded independently of a player's selection of pay lines.

Further, in various embodiments, a player may select a number of reels (virtual or physical) to play. Games of this type are marketed under the trade name "Reel Power" by Aristocrat Leisure Industries Pty Ltd and are also known as "ways" to win games. For example, such a reel selection option may permit the substitution of one displayed symbol for another. In other words, all symbols displayed at symbol display positions corresponding to a selected reel may be used to form symbol combinations with symbols displayed at designated symbol display positions of the other reels. For example, if there are five reels and three symbol display positions for each reel, such that the symbol display positions include three rows of five symbol display positions, the symbols displayed in the center row may be used for non-selected reels. As a result, the total number of ways to win may be determined by multiplying the number of active display positions of each reel, the active display positions being all display positions of each selected reel and the designated display position of the non-selected reels. In this example, for five reels and fifteen display positions, there are 243 ways to win.

As described in greater detail below, a symbol display may include a matrix (e.g., a rectangular matrix) of symbol display positions. The matrix of symbol display positions may, in turn, include a plurality of columns and a plurality of rows. In various embodiments, the number of symbol display positions associated with a column may vary from one column to the next. For example, in an exemplary embodiment, a symbol display may include five columns, in which the first column, the third column, and the fifth column include three symbol display positions and in which the second and fourth columns include four symbol display positions (e.g., a 3-4-3-4-3 column formation). Such a column formation includes seventeen display positions. Moreover, in such a formation, adjacent columns may be offset or staggered relative to one another.

Figure 6:
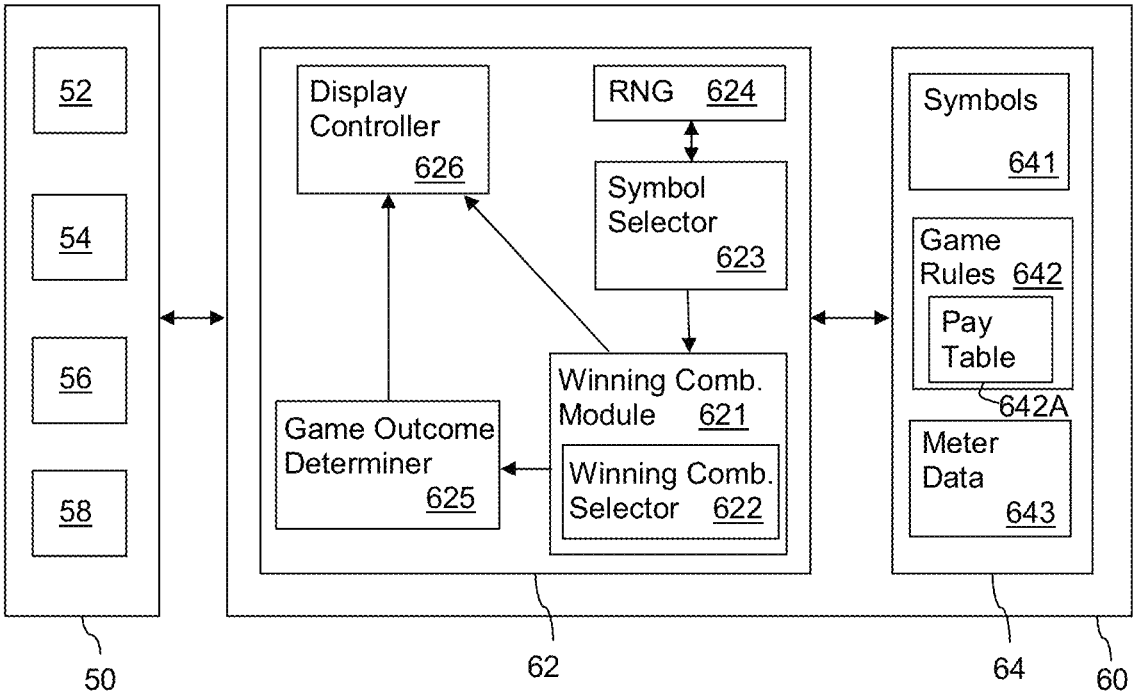
FIG. 6 is a further block diagram of an exemplary gaming system.

FIG. 6 illustrates a block diagram of an exemplary game controller 60 that includes a plurality of software modules, as described below. In an exemplary embodiment, symbols are selected for display in the symbol display positions and a game outcome (e.g. a win entitlement) is determined based on symbols displayed in the selected win lines. Processor 62 of game controller 60 is shown implementing a number of modules based on program code and data stored in memory 64 to conduct the game. Persons skilled in the art will appreciate that one or more of the modules could be implemented in some other way, such as, for example by a dedicated circuit. The modules are adapted to display the symbol display positions in columns, facilitate selection of reels for selection of win lines to be played in the game, select symbols for display in the symbol display positions and determine a game outcome based on the symbols displayed in the played win lines. Persons skilled in the art will appreciate that several of the modules could be implemented in some other way, for example by a dedicated circuit, or on a server remote from game controller 60.

In an exemplary embodiment, game controller 60 include a winning combination module 621 to define all possible win lines for each variation of display of reels and symbol display positions. For example, where there are five reels having 4, 3, 2, 3 and 4 symbol display positions respectively, winning combination module 621 determines that there are 288 (i.e. 4*3*2*3*4) possible win lines which can be played if a player selects all reels. In another example, there are four reels of 4, 3, 2 and 3 symbol display positions respectively. In this case, winning combination module 621 determines that there are 72 possible win lines to be played in the game. A pay table 642A may be referenced to identify a payout or award based upon an identified winning combination of symbols.

In an exemplary embodiment, winning combination module 621 also includes a winning combination selector 622, which may operate in response to the player's operation of game play mechanism 56 to place a wager, and thereby, initiate game play. Thus, as described herein, a game outcome may be generated and evaluated (e.g., by winning combination selector 622 and/or symbol selector 623). In the exemplary embodiment, the winning combination selector 622 may form the game outcome using a symbol selector 623 to select symbols from a set of symbols specified by symbol data 641 based upon one or more random numbers output by random number generator 624. The selected symbols may be transmitted to display controller 626, which may cause each symbol to be displayed on display 54 at a selected set of symbol display positions. Symbol data 641, game rules 642, pay table 642A, and meter data 643 (for purposes including ensuring regulatory compliance and monitoring player) are stored in memory 64.

In an exemplary embodiment, symbol selector 623 may select one or more symbols from a plurality of symbol sets. Each symbol set may be displayed as part of a "reel strip," which, as used herein, may include a plurality of symbols displayed within a column of symbol display positions. Symbol selector 623 may thus select a plurality of symbols for display within a matrix of symbol display positions, as described above.

In an exemplary embodiment, some (or all) of the symbols selected by symbol selector 623 may include jackpot symbols. Selected jackpot symbols may be used to fill one or more symbol display positions within a plurality of reel strips. In addition, as used herein, a "stack" of symbols may include those symbols located within a particular column or reel strip. In an exemplary embodiment, a "full stack" of symbols may refer to a column or a reel strip in which each of the symbol display positions including the column or reel strip is associated or filled with a particular symbol, such as a jackpot symbol or any other designated symbol.

In an exemplary embodiment, symbol selector 623 may select symbols for display by selecting a stopping position in the sequence of symbols displayed on a reel strip. The number of symbols displayed may depend upon the number of reel strips displayed as well as upon the number of symbols (or symbol display positions) included in each reel strip. For example, a gaming machine that includes five reel strips of four symbols each may display twenty symbols at a time. Similarly, a gaming machine that includes five reel strips of three symbols each may display fifteen symbols at a time. In various embodiments, a probability table stored in memory 64 may be referenced to vary the odds of a particular reel stop position being selected. Other techniques may also be used to control the odds of particular outcomes occurring.

Display controller 626 receives the selected symbols and displays the selected symbols in symbol display positions such that a player selected win line includes one symbol display position and thus one symbol from each column. A game outcome determiner 625 then determines an outcome of the game based on the symbols selected for display in the played win lines. The result of the determination (e.g. whether the player is entitled to a prize) is then transmitted to display controller 626 for display on display 54.

Figure 8A:
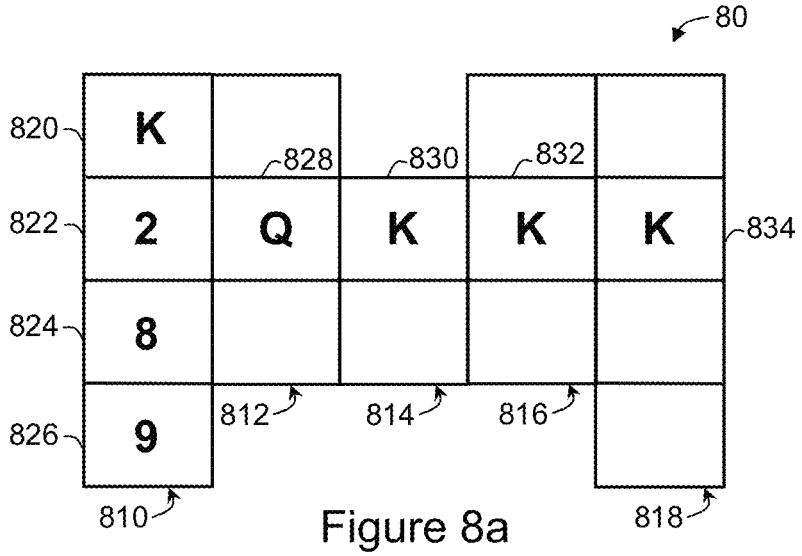
FIGS. 8*a* and 8*b* are exemplary reel displays that may appear during electronic gaming.

An example of a game employing the above method is described with reference to FIGS. 8*a* and 8*b*. Example 80 shown in FIG. 8*a* illustrates a display with first reel 810 selected by the player for selection of win lines to be played. Winning combination selector 622 operates in response to the player's operation of game play mechanism 56 to select the first reel for selection of win lines to be played in the game. Winning combination module 621 defines the win lines to be played as having at least one symbol display position 820, 822, 824, and 826 from reel 810 and a designated symbol display position from each of reels 812, 814, 816, and 818, which the player did not select. That is, the winning combination module 621 defines four win lines to be played in the game out of a possible 288.

Symbol Display Positions

Win line 1: 820 828 830 832 834
Win line 2: 822 828 830 832 834
Win line 3: 824 828 830 832 834
Win line 4: 826 828 830 832 834

It will be appreciated by those skilled in the art that the designated symbol display positions from each of reels 812, 814, 816, and 818 need not be located in a row. In addition, the designation of symbol display positions to form a win line may be specified in game rules 642 or may be designated at random.

In example 80, symbol selector 623, in association with random number generator 624, selects symbols from symbol data 641. The selected symbols are transmitted to display controller 626 for display in the corresponding symbol display positions. It can be seen from example 80 that game outcome determiner 625 would not determine that a winning combination of symbols was displayed in any of the played win lines.

Symbols

| | | | | | |
|---|---|---|---|---|---|
| Win line 1: | K | Q | K | K | K |
| Win line 2: | 2 | Q | K | K | K |
| Win line 3: | 8 | Q | K | K | K |
| Win line 4: | 9 | Q | K | K | K |

Figure 8B:
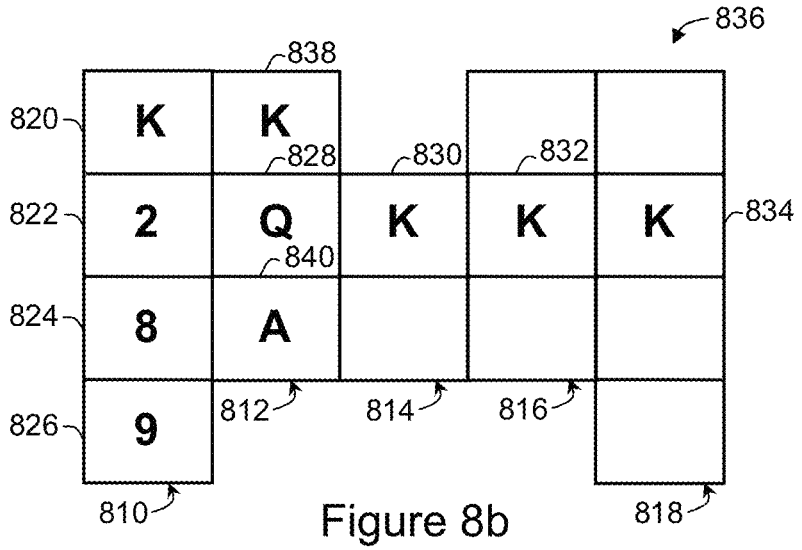

FIG. 8*b* shows an example 836 where both first reel 810 and second reel 812 are selected by a player for the selection of win lines to be played in the game. That is, winning combination selector 622 operated in response to the player's operation of game play mechanism 56 to select both the first and second reels. In this example, winning combination module 621 defined twelve win lines to be played out of a possible 288.

In example 836, symbol selector 623 selects symbols and transmits the selected symbols to display controller 626 for display in the symbol display positions. In this example, game outcome determiner 625 determines that a winning combination of symbols (5 Kings) was displayed in one of the played win lines (Win line 1).

Symbols

| | | | | | |
|---|---|---|---|---|---|
| Win line 1: | K | K | K | K | K |
| Win line 2: | K | Q | K | K | K |
| Win line 3: | K | A | K | K | K |
| Win line 4: | 2 | K | K | K | K |
| Win line 5: | 2 | Q | K | K | K |
| Win line 6: | 2 | A | K | K | K |
| Win line 7: | 8 | K | K | K | K |
| Win line 8: | 8 | Q | K | K | K |
| Win line 9: | 8 | A | K | K | K |
| Win line 10: | 9 | K | K | K | K |
| Win line 11: | 9 | Q | K | K | K |
| Win line 12: | 9 | A | K | K | K |

Figure 9A:
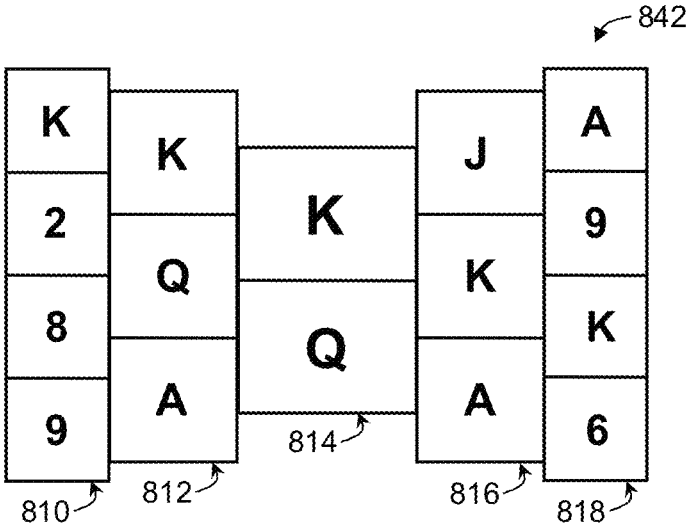
FIGS. 9*a* and 9*b* are exemplary reel displays that may appear during electronic gaming.
Figure 9B:
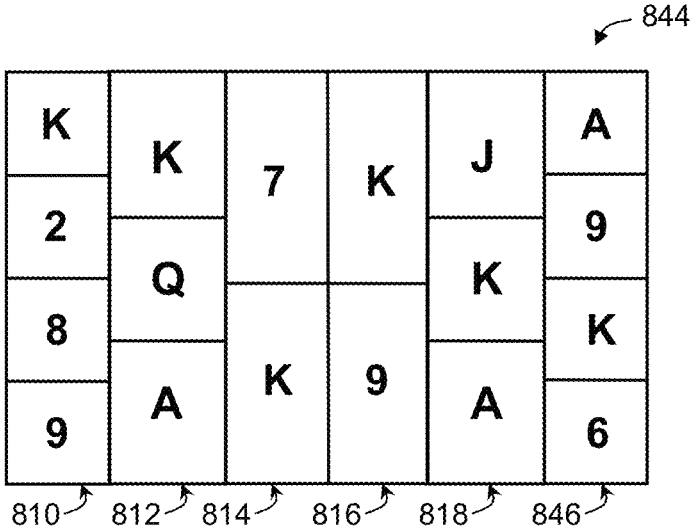

Another example of a game employing the above method is described with reference to FIGS. 9*a* and 9*b*. Example 842 shown in FIG. 9*a* illustrates a display with the five reels 810, 812, 814, 816, and 818. However, the reels and symbol display positions are of non-uniform size. The size of the symbol display positions and/or the reels may be specified in game rules 642 or may be designated at random. The designation of symbol display positions (e.g. number of symbol display positions or size of symbol display positions) in each column (e.g. reel) may be specified in game rules 642 or may be designated at random. For example, it may be specified that adjacent designated symbol display positions in non-selected reels are aligned horizontally on the display.

In example 842, reels 810, 812, 814, 816, and 818 have symbol display positions in different sizes, and the size of the symbol display positions in one reel corresponds to the number of symbol display positions in the reel. Central reel 814 includes two symbol display positions that display larger sized symbol display positions than reels 812 and 816. Reels 812 and 816, in turn, display larger sized symbol display positions than reels 810 and 818. However, a different relationship between the number of symbol display positions in a reel and the symbol display position size may be employed, such as the inverse of the above relationship.

In example 842, reels 810, 812, 814, 816, and 818 are selected by the player for selection of win lines to be played. Thus, winning combination module 621 defines 288 win lines to be played. Game outcome determiner 625 determines that a winning combination of symbols (5 Kings) was displayed in a played win lines.

Example 844 shown in FIG. 9*a* also illustrates a display with reels and symbol display positions having non-uniform sizes. In this example, there is a sixth reel 846, and the displayed size of the symbol display positions is such that the top of the first symbol display position and the bottom of the last symbol display position of adjacent reels are aligned. Reels 810, 812, 814, 816, 818, and 846 are selected by the player for selection of win lines to be played. In this example, reels have 4, 3, 2, 2, 3 and 4 symbol display positions respectively, thus winning combination module 621 defines 576 win lines to be played. Game outcome determiner 625 determines that a winning combination of symbols (6 Kings) is displayed in a played win lines.

Figure 7:
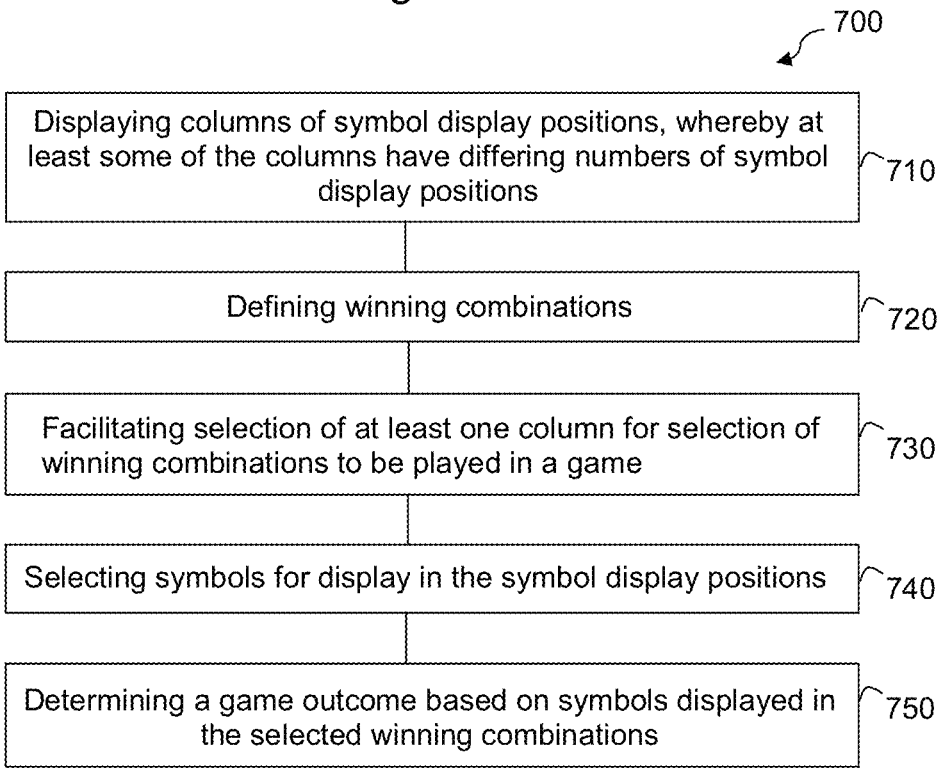
FIG. 7 is a flow chart of an exemplary method of electronic gaming.

FIG. 7 is a flowchart of an exemplary method 700 of electronic gaming. Method 700 includes displaying 710 columns of symbol display positions, whereby at least some of the columns have differing numbers of symbol display positions. Method 700 further includes defining 720 winning combinations (e.g. win lines) of symbol display positions having at least one symbol display position from each of the columns, and facilitating 730 selection of at least one of the columns by a player for selection of winning combinations (e.g. win lines) to be played in a game, the selected winning combinations to be played including all possible winning combinations derivable from all symbol display positions of the selected at least one column and a designated symbol display position from each of the columns which the player did not select. In addition, method 700 further includes selecting 740 symbols for display in the symbol display positions and determining 750 a game outcome based on symbols displayed in the selected winning combinations.

Further aspects of the method will be apparent from the above description of the system. It will be appreciated that at least part of the method may be implemented electronically, such as, for example, digitally by a processor executing program tangible, non-transitory, computer-readable program code or instructions that, when executed by the processor, cause the processor to perform operations as described herein, such as in the above description of a game controller. In this respect, in the above description, certain steps are described as being carried out by a processor of a gaming system, it will be appreciated that such steps may require a number of sub-steps to be carried out for the steps to be implemented electronically, such as, for example due to hardware or programming limitations. For example, to carry out a step such as evaluating, determining, or selecting, a processor may compute several values and compare those values.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" or "including" is used in an inclusive sense, i.e., to specify the presence of the stated features but not to preclude the presence or addition of further features in various embodiments of the invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A gaming system for conducting a game, said gaming system comprising:
- a display device;
- an input interface;
- at least one processor; and
- a memory device storing instructions which, when executed by the at least one processor, cause the processor to at least:
  - cause to be displayed, by the display device, a plurality of columns, each column of the plurality of columns including a plurality of symbol display positions, the plurality of columns including a first column having a first number of display positions and a second column having a second number of display positions;
  - receive, via the input interface, a selection of at least one column of the plurality of columns;
  - determine, based upon the selection, a set of win lines to be played during the game, wherein the set of win lines is defined, at least, by:
    - combining each symbol display position of the at least one selected column with one symbol display position of each non-selected column, wherein, when a single column is selected, a number of win lines in the set of win lines is equal to a total number of symbol display positions of the single selected column, and wherein, when more than one column is selected, the number of win lines in the set of win lines is equal to a number of symbol display positions of a first selected column multiplied by a respective number of symbol display positions of each other selected column;
  - determine a symbol to be displayed at each symbol display position of each column of the plurality of columns;
  - populate each symbol display position of each column of the plurality of columns with a symbol; and
  - determine an outcome of the game based on the populated symbols and the set of win lines to be played.

2. The gaming system of claim 1, wherein the first number of display positions of the first column is different than the second number of display positions of the second column.

3. The gaming system of claim 1, wherein the first number of display positions of the first column is equal to the second number of display positions of the second column.

4. The gaming system of claim 1 further comprising a credit input mechanism configured to establish a credit balance and a cash out device configured to pay out the credit balance.

5. The gaming system of claim 1 further comprising a gaming server in networked communication with the at least one processor, wherein determining an outcome of the game is performed by the gaming server.

6. The gaming system of claim 1, wherein the first number of display positions of the first column is greater than the second number of display positions of the second column, wherein a first display position size of display positions in the first column is smaller than a second display position size of display positions in the second column.

7. The gaming system of claim 1, wherein the at least one processor is further configured to horizontally align a plurality of non-selected columns of the plurality of columns.

8. A method of conducting a game on an electronic gaming machine, the method comprising:
- causing to be displayed a plurality of columns, each column of the plurality of columns including a plurality of symbol display positions, the plurality of columns including a first column having a first number of display positions and a second column having a second number of display positions;

receiving a selection of at least one column of the plurality of columns;

defining, based upon the selection, a set of win lines to be played during the game, wherein the set of win lines is defined, at least, by:

combining each symbol display position of the at least one selected column with one symbol display position of each non-selected column, wherein, when a single column is selected, a number of win lines in the set of win lines is equal to a total number of symbol display positions of the single selected column, and wherein, when more than one column is selected, the number of win lines in the set of win lines is equal to a number of symbol display positions of a first selected column multiplied by a respective number of symbol display positions of each other selected column;

populating each symbol display position of each column of the plurality of columns with a symbol; and determining an outcome of the game based on the populated symbols and the defined set of win lines.

9. The method of claim 8, wherein the first number of display positions of the first column is different than the second number of display positions of the second column.

10. The method of claim 8, wherein the first number of display positions of the first column is equal to the second number of display positions of the second column.

11. The method of claim 8 further comprising establishing a credit balance in response to receiving an input from a physical item.

12. The method of claim 8 further comprising performing a cash out operation of an active balance in response to receiving an input.

13. The method of claim 8, wherein the first number of display positions of the first column is greater than the second number of display positions of the second column, wherein a first display position size of display positions in the first column is smaller than a second display position size of display positions in the second column.

14. The method of claim 8 further comprising horizontally aligning a plurality of non-selected columns of the plurality of columns.

15. A non-transitory computer-readable medium storing instructions thereon that, when executed by at least one processor, cause the at least one processor to:

cause to be displayed a plurality of columns, each column of the plurality of columns including a plurality of symbol display positions, the plurality of columns including a first column having a first number of display positions and a second column having a second number of display positions;

receive a selection of at least one column of the plurality of columns;

define, based upon the selection, a set of win lines to be played during a game, wherein the set of win lines is defined, at least, by:

combining each symbol display position of the at least one selected column with one symbol display position of each non-selected column, wherein, when a single column is selected, a number of win lines in the set of win lines is equal to a total number of symbol display positions of the single selected column, and wherein, when more than one column is selected, the number of win lines in the set of win lines is equal to a number of symbol display positions of a first selected column multiplied by a respective number of symbol display positions of each other selected column;

populate each symbol display position of each column of the plurality of columns with a symbol; and determine an outcome of the game based on the populated symbols and the defined set of win lines.

16. The non-transitory computer-readable medium of claim 15, wherein the first number of display positions of the first column is different than the second number of display positions of the second column.

17. The non-transitory computer-readable medium of claim 15, wherein the first number of display positions of the first column is equal to the second number of display positions of the second column.

18. The non-transitory computer-readable medium of claim 15, wherein the instructions further cause the at least one processor to establish a credit balance in response to receiving an input from a physical item.

19. The non-transitory computer-readable medium of claim 15, wherein the instructions further cause the at least one processor to perform a cash out operation of an active balance in response to receiving an input.

20. The non-transitory computer-readable medium of claim 15, wherein the first number of display positions of the first column is greater than the second number of display positions of the second column, wherein a first display position size of display positions in the first column is smaller than a second display position size of display positions in the second column.

* * * * *